United States Patent [19]

Mowatt-Larssen

[11] 4,002,192

[45] Jan. 11, 1977

[54] RAILWAY TANK CAR TRAIN HAVING A TWO-WAY LOADING AND UNLOADING SYSTEM

[75] Inventor: Erling Mowatt-Larssen, Warren, Ohio

[73] Assignee: General American Transportation Corporation, Chicago, Ill.

[22] Filed: May 30, 1975

[21] Appl. No.: 582,197

[52] U.S. Cl. ..... 141/35; 105/1 R; 105/358; 137/347; 137/572; 141/59; 141/374

[51] Int. Cl.[2] ..... B61D 5/08; B65B 3/04; E03B 7/04; F17D 1/12

[58] Field of Search ..... 105/1 A, 1 R, 358, 360, 105/3; 137/256, 571, 347, 572; 214/83.28, 301, 310; 302/22, 64; 141/35, 59, 374

[56] References Cited

UNITED STATES PATENTS

| | | | |
|---|---|---|---|
| 97,807 | 12/1869 | Powell | 105/1 R X |
| 227,550 | 5/1880 | Lloyd | 105/1 R X |
| 319,358 | 6/1885 | Van Duzer | 105/1 R X |
| 1,542,116 | 6/1925 | Welcker | 105/358 X |
| 1,560,917 | 11/1925 | Stubbs | 105/1 R X |
| 1,608,224 | 11/1926 | Mauran | 105/358 |
| 2,102,124 | 12/1937 | Lithgow | 105/358 X |
| 3,722,556 | 3/1973 | Jeffers et al. | 105/358 X |
| 3,849,197 | 11/1974 | Sorrentino | 137/571 X |
| 3,906,995 | 9/1975 | Schmidt | 105/358 |

*Primary Examiner*—Robert J. Spar
*Assistant Examiner*—Howard Beltran
*Attorney, Agent, or Firm*—Prangley, Dithmar, Vogel, Sandler & Stotland

[57] ABSTRACT

A railway train made up of individual tank cars for interconnection and fluid communication with associated-like tank cars by flexible connecting conduits, wherein each tank car includes a wheeled chassis structure provided with coupling means for coupling adjacent tank cars. A tank is mounted on the chassis structure and has two lading conduits respectively coupled to the tank and in fluid communication therewith, each of the lading conduits having an outer end extending outwardly from the tank adjacent to the top thereof. Each of the lading conduits is connected to a vent conduit and to an eduction conduit with the vent conduit extending into the tank and having the inner end thereof terminating a predetermined distance from and near the top of the tank and with the eduction conduit extending into the tank and having the inner end thereof terminating near the bottom of the tank. Valves are provided to interrupt communication between the vent conduits and the lading conduits and between the eduction conduits and the lading conduits. The above structure enables tank cars to be loaded or unloaded from either end thereof.

15 Claims, 7 Drawing Figures

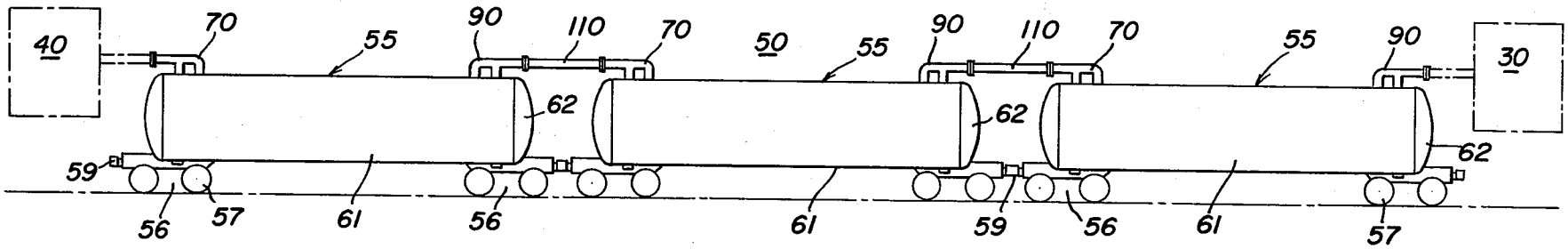
FIG. 1
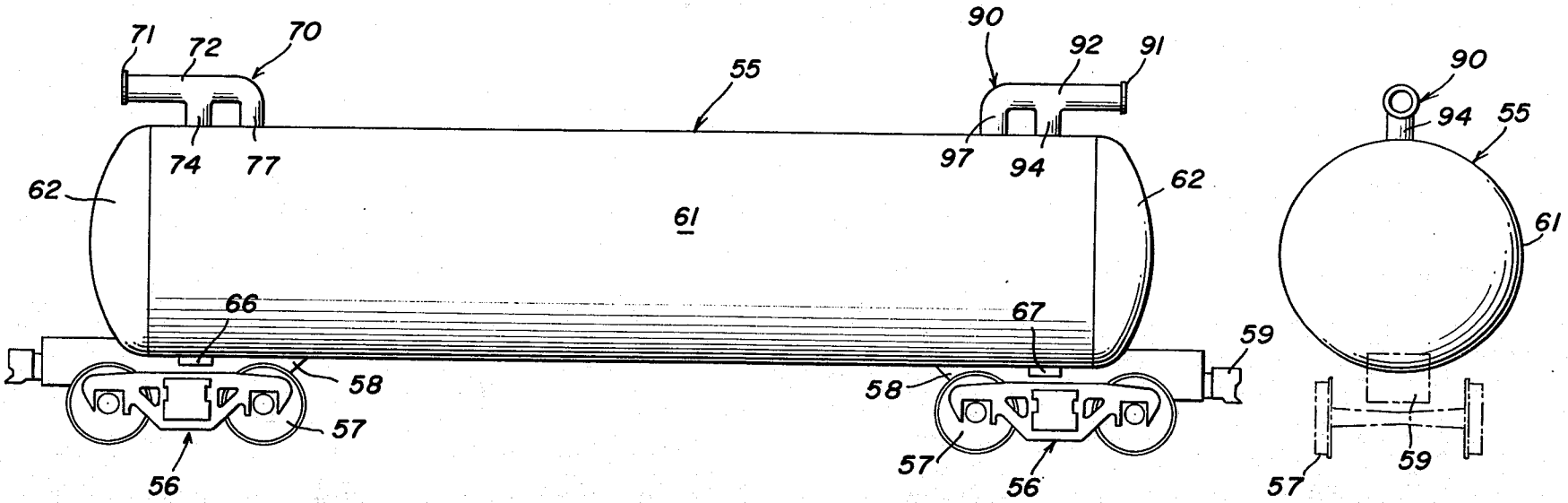
FIG. 2
FIG. 3

RAILWAY TANK CAR TRAIN HAVING A TWO-WAY LOADING AND UNLOADING SYSTEM

CROSS REFERENCE TO RELATED APPLICATIONS

This application is an improvement of application Ser. No. 403,828, filed Oct. 5, 1973, for MANIFOLDED TANK CARS FOR UNIT TRAIN SERVICE.

BACKGROUND OF THE INVENTION

The present invention relates to railway tank cars and, in particular, to manifolded tank cars which may be interconnected to accommodate loading or unloading of the entire group of interconnected cars without movement thereof from a single point and from either end of the train. In addition, individual ones of the tank cars may be loaded or unloaded from either end thereof, thereby accommodating consecutive loading, transporting and unloading of fluid ladings and facilitating the formation of unit trains.

The concept of providing fluid communication among a series of interconnected railway tank cars is disclosed in the prior art but previous systems have failed to provide an intertank connection arrangement which insured safe and convenient handling of the fluid ladings during transportation. For example, U.S. Pat. No. 1,542,116, issued to R. Welcker, discloses railway tank cars for interconnection in a manifolded arrangement to accommodate continuous emptying of the interconnected tanks from a single location without moving or disconnecting the cars. However, Welcker's arrangement does not provide for continuous loading of the interconnected tanks from a single location, and the intertank lading connections are along the longitudinal axes of the tanks which has been found to be a disadvantageous arrangement. Additionally, Welcker does not show a tank car which can be loaded or unloaded from either end thereof while providing the free vapor space or "outage" of the present invention. Furthermore, Welcker provides exposed valves for controlling the fluid lading flow, which valves must be individually manually operated.

U.S. Pat. No. 3,722,556, issued to William Jeffers et al., discloses a manifolded tank car arrangement which accommodates both loading and unloading of a string of interconnected tank cars from a single location, but Jeffers et al. provide the intertank lading connections at the bottoms of the tanks, and, in addition, they provide exposed and unprotected lading flow control valves, whereby to present a substantial safety hazard during transit of the tank car. Further, Jeffers et al. do not provide a lading conduit which, during loading, automatically determines the final outage of the lading in the tank and also accommodates loading and unloading from either end thereof, a combination of features which is critically necessary to save time in loading and unloading of unit tank trains and to accommodate certain bulk lading commodities which expand during transit.

SUMMARY OF THE INVENTION

This invention relates to a railway tank car which may be loaded or unloaded from either end thereof and more particularly this invention relates to a tank car in which two lading conduits are respectively coupled to the tank car and are in fluid communication therewith, with each of the lading conduits being in fluid communication with a vent conduit and an eduction conduit.

It is an important object of the present invention to provide a railway tank car which can be loaded or unloaded from either end thereof.

It is another object of the present invention to provide a railway tank car for interconnection in fluid communication with associated tank cars by flexible connecting conduits for accommodating consecutive loadings, unloading and transportation of expandable ladings, the tank car comprising a wheeled chassis structure provided with chassis coupling means for coupling to the chassis of associated cars, a tank mounted on the chassis structure, lading conduit means mounted on the top of the tank and having two outer ends extending outwardly from the tank adjacent to the top thereof, an eduction conduit having an outer end in fluid communication with the lading conduit means and having an inner end in fluid communication with the interior of the tank, the inner end of the eduction conduit being positioned near the bottom of the tank to facilitate the emptying of the tank through the eduction conduit, two vent conduits each having an outer end in fluid communication with the lading conduit means and having an inner end in fluid communication with the interior of the tank, the inner end of each of the vent conduits extending into the tank and terminating a predetermined distance below the top of the tank, and a plurality of valves for interrupting communication between the vent conduits and the lading conduit means and between the eduction conduit and the lading conduit means, whereby the tank may be loaded and unloaded from either end of the lading conduit means by adjustment of the valves to interrupt communication between the one end of the lading conduit means and the adjacent vent conduit and to interrupt communication between the other end of the conduit means and the eduction conduit.

It is yet another object of the present invention to provide a railway tank car of the type set forth in which each lading conduit is respectively in fluid communication with one vent conduit and one eduction conduit located near the adjacent end of the tank car.

A further object of the present invention is to provide a railway tank car of the type set forth in which the two lading conduits are in fluid communication with a single eduction conduit which has the terminal end thereof positioned near the bottom of the tank car midway between the ends thereof.

Another object of the present invention is to provide a railway train comprised of tank cars of the type hereinbefore set forth.

These and other objects of the present invention together with further objects and advantages thereof will best be understood by reference to the following specification taken in connection with the accompanying drawings.

BRIEF DESCRIPTION OF THE DRAWINGS

FIG. 1 is a side elevational view of a train of individual tank cars particularly illustrating the present invention which enables the cars to be loaded or unloaded from either end thereof;

FIG. 2 is an enlarged side elevation view of an individual one of the tank cars illustrated in the train of FIG. 1;

FIG. 3 is an end elevation view of the tank car shown in FIG. 2;

DESCRIPTION OF THE PREFERRED EMBODIMENTS

Figure 4:
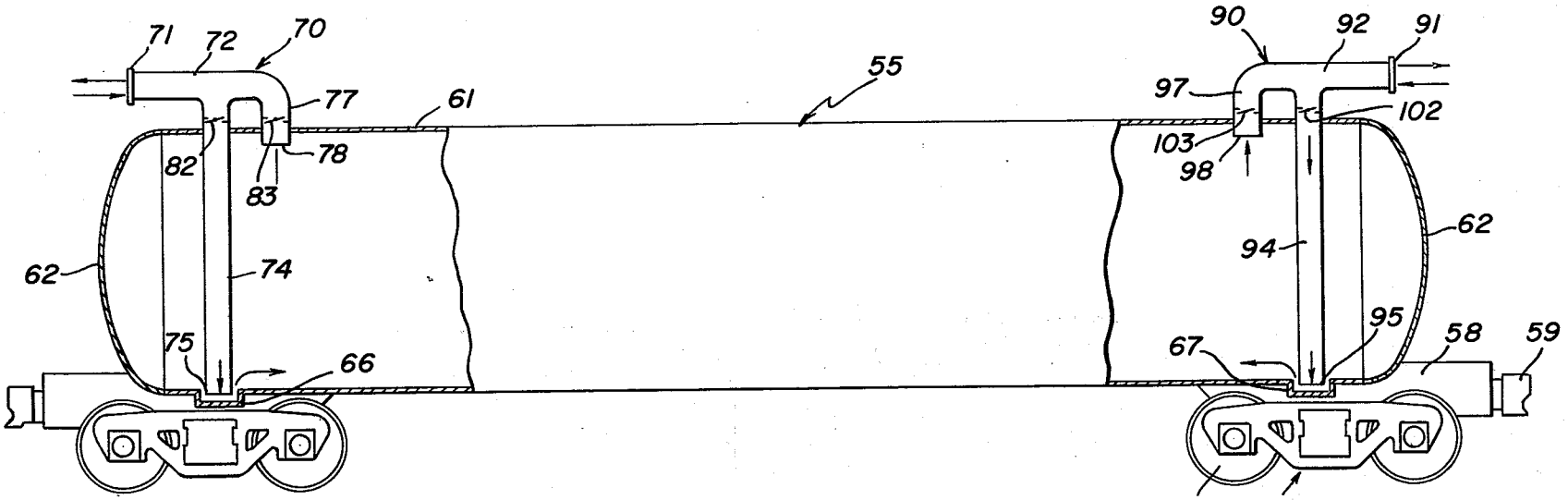
FIG. 4 is a side elevation view partly in section of the railway tank car shown in FIG. 2, particularly illustrating the position of the eduction conduits with respect to the sumps in the bottom of the tank cars.

Referring now to FIGS. 1 to 4 of the drawings, there is disclosed a railway train 50 comprised of individual tank cars 55, each of which is provided with a pair of spaced-apart trucks 56 carrying wheels 57 adapted to ride on a standard railway rail. Each of the trucks 56 is also provided with draft sill 58 and a coupling mechanism 59 at the end of the draft sill. The tank car 55 includes a generally cylindrical shell 61 closed at each end thereof by dome ends 62, thereby to form a closed lading structure. The car 55 is provided with spaced-apart sumps 66 and 67 at the bottoms of the shells 61 adjacent to each of the domed ends 62 thereof.

The tank car 55 is provided with a conduit 70 which includes a mounting flange 71 on the end thereof adjacent to the respective dome 62 but inboard of the dome end. The conduit 70 includes a pipe manifold 72 extending parallel to the longitudinal axis of the tank car 55 and inboard from the mounting flange 71. The pipe manifold 72 is in fluid communication with an eduction pipe 74 which extends vertically downwardly through the tank car 55, the eduction pipe 74 having an end 75 terminating in the sump 66. The manifold pipe 72 is also in fluid communication with a vent pipe 77 extending vertically downwardly into the tank car 55 and having an end 78 thereof terminating a predetermined distance below and near the top of the tank car 55, all for a purpose hereinafter set forth.

The eduction pipe 74 is provided with a bufferfly valve 82 positioned therein externally of the tank car 55. Similarly, the vent pipe 77 is provided with a butterfly valve 83 positioned therein externally of the tank car 55. Proper and well known controls (not shown) for the valves 82 and 83 provide independent operation, enabling one of the valves to be open while the other valve is shut.

The other end of the tank car 55 is provided with a conduit 90 similar to the conduit 70, which includes a mounting flange 91 positioned adjacent to the top of the tank car 55 at a point inboard of the adjacent dome end 62. A manifold pipe 92 extends inboard from the mounting flange 91 and is generally parallel to the longitudinal axis of the tank car 55. The manifold pipe 92 is in fluid communication with a downwardly or vertically extending eduction pipe 94 which has an end 95 terminating in the sump 67. The manifold pipe 92 also is in fluid communication with a vent pipe 97 extending vertically downwardly through the top of the tank car 55 and having an end 98 terminating a predetermined distance below the top of the tank car 55. A butterfly valve 102 is positioned in the eduction conduit 94 externally of the tank car 55 and a butterfly valve 103 is positioned in the vent conduit 97 externally of the tank car 55. Suitable controls for the butterfly valves 102 and 103 are provided in the usual manner but are not herein illustrated.

It is seen, therefore, that there is then provided a plurality of tank cars 55 each having conduits 70 and 90 at the respective ends of each of the tank cars. Each of the conduits is provided with both a vent pipe and an eduction pipe. Adjacent tank cars 55 are interconnected with flexible connecting conduits 110, each of the flexible conduits 110 being provided with mechanisms at the ends thereof for connection to the mounting flanges 71 and 91 of the conduits 70 and 90, respectively.

In operation, the tank car 55 may conveniently be loaded or unloaded from either end thereof. For instance, if it is desired to load the tank car 55, as seen in FIG. 4, from the left end or through the conduit 70, that is to use the conduit 70 as an inlet conduit, then the valve 82 in the eduction pipe 74 is opened and the valve 83 in the vent pipe 78 is closed. At the other end of the tank car 55, the conduit 90 is used as an outlet conduit and in that case the valve 102 in the eduction conduit is closed and the valve 103 in the vent pipe 97 is opened. Therefore, in order to use the conduit 70 as an inlet conduit, the valve 82 is opened and the valve 83 is closed and in order to use the conduit 90 as an outlet conduit, the valve 102 is closed and the valve 103 is open.

As lading enters the conduit 70 it flows downwardly through the eduction pipe 74 and into the tank car 55. As the level of lading rises in the tank car 55, eventually the liquid level reaches the end 98 of the vent pipe 97. When the liquid level reaches the end 98 of the vent pipe 97, then pressure begins to build in the tank car 55 between the top thereof and the liquid lading. When the pressure is sufficient then liquid lading will be forced upwardly through the vent pipe 97, the open valve 103 and into the manifold pipe 92. Therefore, the outage or level to which the tank car 55 is filled can be predetermined by the length that the vent pipe 97 extends into the tank car. Since the valve 102 is closed, the lading will flow outwardly from the tank car through the conduit 90 into the flexible conduit 110 and into the adjacent tank car 55. This process is continued until the entire train 50 is filled.

Alternatively, if it is desired to use the conduit 90 as an inlet conduit and the conduit 70 as an outlet conduit, then the valving is reversed. Specifically, the valve 102 in the eduction pipe 94 is opened and the valve 103 in the vent pipe 97 is closed, thereby to put the conduit 90 into condition to operate as an inlet conduit. Specifically, the valve 82 of the eduction pipe 74 is closed and the valve 83 of the vent pipe is open, thereby to put the conduit 70 into condition to operate as outlet conduit. It is clear, therefore, that either the conduit 70 or the conduit 90 may be used as an inlet conduit or as an outlet conduit, depending on the position of the valves attendant thereto.

When the tank car 55 is desired to be unloaded, it may also be unloaded from either end thereof, a feature which, in combination with the loading feature, gives great flexibility to the tank car of the present invention. If it is desired to unload the tank car 55 through the conduit 70, then the valve 83 in the vent pipe 77 is closed and the valve 82 in the eduction conduit 74 is opened. The conduit 90 will have to function as an inlet conduit in order for the tank car 55 to be unloaded through the conduit 70. Accordingly, the valve 102 in the eduction pipe 94 is closed and the valve 103 in the vent pipe 97 is opened. Air or some other gas such as nitrogen under pressure is introduced into the tank car 55 through the vent pipe 97 by connecting the conduit 90 to a suitable source of gas. As the gas under pressure enters the tank car 55, liquid lading is forced out of the tank car through the conduit 70. Since the end 75 of the eduction pipe 74 is located in the sump 66, all of the liquid lading in the tank car 55, except for a very minor amount in the bottom of the sump 66, can be forced out of the car by the air or nitrogen under pressure. The flow path of the liquid lading is as described. Since the valve 83 in the vent pipe 77 is closed, the tank car 55 becomes an air or gas tight chamber as long as lading covers the end 75 of the eduction pipe 74 and, accordingly, pressure can build up inside the chamber as air or nitrogen is introduced through the pipe 97 thereby to force the liquid lading out of the tank car 55 through the eduction pipe 74 and the manifold pipe 72. When it is desired to empty an entire train 50 of tank cars 55, this process may be used to empty the entire train seriatim.

When the tank car 55 is most advantageously unloaded through the conduit 90 rather than the conduit 70, the tank car may be accommodated for such unloading by a simple changing of the valving. In order to unload the tank car 55 through the conduit 90, the valve 102 in the eduction pipe 94 is opened and the valve 103 in the vent pipe 97 is closed. Further, the valve 82 in the eduction pipe 74 is closed and the valve 83 in the vent pipe 77 is opened. Thereafter, a source of air or nitrogen under pressure is connected to the conduit 70 and the gas under pressure pumped into the tank car 55 thereby to drive the liquid lading out of the tank car 55 through the conduit 90 and, more specifically, to drive the liquid lading up through the eduction conduit 94 via the end 95 thereof and hence out of the manifold pipe 92 into the next adjacent car or into a storage facility.

Accordingly, it is seen that there has been described a tank car 55 having conduits 70 and 90 at each end thereof, either of which may function as an inlet conduit or an outlet conduit. The above construction is particularly advantageous in that a train 50 of such tank cars 55 may be loaded or unloaded from either end of the train or, for that matter, individual cars may be loaded or unloaded from either end thereof without regard to which end is in the inlet or the outlet.

Figure 5:
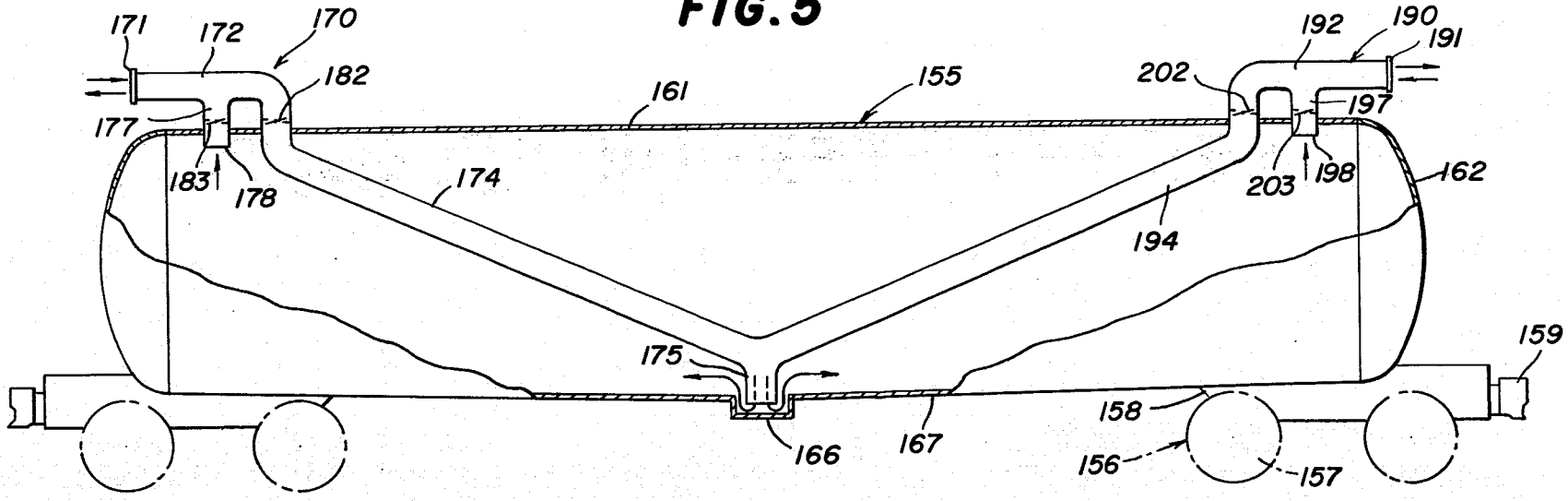
FIG. 5 is a sectional view partly in elevation of another embodiment of the present invention, particularly illustrating a joined eduction conduit with the vent conduits being positioned adjacent to the ends of the car.

Referring now to FIG. 5, of the drawings, there is disclosed an alternative embodiment of the tank car 55 illustrated in FIGS. 1 to 4. The tank car 155 includes a pair of spaced-apart trucks 156, carrying wheels 157 adapted to ride on a standard railway rail. Each of the trucks 156 is also provided with a draft sill 158 and a coupling mechanism 159 at the end of the draft sill. The tank car 155 includes a generally cylindrical shell 161 closed at each end thereof by dome ends 162, thereby to form a closed lading structure. Car 155 is provided with a central sump 166 positioned substantially in the center of the car 155, it being noted that the bottom of the cylindrical shell 161 slopes downwardly from the ends 162 thereof toward the sump 166.

The tank car 155 is provided with a conduit 170 which includes a mounting flange 171 at the end thereof adjacent to the respective dome end 162 but inboard thereof. The conduit 170 includes a pipe manifold 172 extending parallel to the longitudinal axis of the tank car 155 and inboard from the mounting flange 171. The pipe manifold 172 is in fluid communication with an eduction pipe 174 which extends diagonally downwardly through the tank car 155, the eduction pipe 174 terminating in a short vertically downwardly extending pipe section 175 positioned in registry with the sump 166. The manifold pipe 172 is also in fluid communication with a vent pipe 177 extending vertically downwardly into the tank car 155 and having an end 178 thereof terminating a predetermined distance below the top of the tank car 155.

The eduction pipe 174 is provided with a butterfly valve 182 positioned therein externally of the tank car 155. Similarly, the vent pipe 177 is provided with a butterfly valve 183 positioned therein externally of the tank car 155. Proper controls (not shown) for the valves 182 and 183 provide independent operation thereof enabling one of the valves to be opened while the other valve is shut.

The other end of the tank car 155 is provided with a conduit 190 similar to the conduit 170, which includes a mounting flange 191 positioned adjacent to the top of the tank car 155 at a point inboard of the adjacent dome end 162. A manifold pipe 192 extends inboard from the mounting flange 191 and is generally parallel to the longitudinal axis of the tank car 155. The manifold pipe 192 is in fluid communication with a diagonally downwardly extending eduction pipe 194 which terminates at the other end thereof in fluid communication with the eduction pipe 174, both the eduction pipes 174 and 194 joining to form a single downwardly extending vertical pipe 175 positioned over the sump 166. The manifold pipe 192 is also in fluid communication with a vent pipe 197 extending vertically downwardly through the top of the tank car 155 and having an end 198 terminating a predetermined distance below the top of the tank car 155. A butterfly valve 202 is positioned in the eduction conduit 194 externally of the tank car 155 and a butterfly valve 203 is positioned in the vent conduit 197 externally of the tank car 155. Suitable controls for the butterfly valves 202 and 203 are provided in the usual manner but are not herein illustrated.

Operation of the tank car 155 is identical to the operation of the tank car 55 hereinbefore described. Both of the conduits 170 and 190 may function as either an inlet conduit or an outlet conduit and the tank car 155 may be loaded or unloaded from either end, all in the same manner as the tank car 55. The provision of a downwardly sloping bottom wall 167 and a single sump 166 provides a further means for emptying the tank car 155 with the only lading left in the car being a very thin layer of lading in the bottom of the sump 166. In general, the embodiment shown in FIG. 5 is every bit as effective in loading and unloading as the embodiment shown in FIGS. 1 to 4 and, in fact, the embodiment shown in FIG. 5 leaves less lading in the tank car than the previous embodiment.

Figure 6:
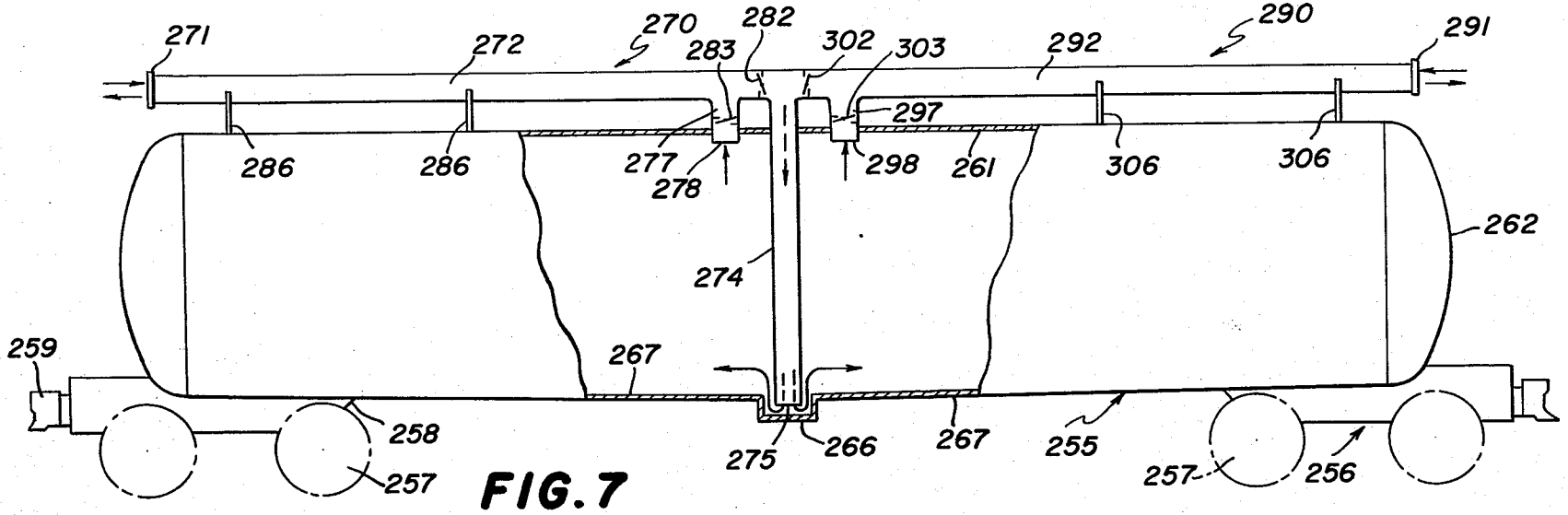
FIG. 6 is an elevation view partly in section showing yet another embodiment of the present invention in which a common eduction conduit is positioned centrally of the tank car terminating in a sump at the bottom of the sloping bottom wall of the tank car.

Referring now to FIG. 6, there is disclosed yet another embodiment of the present invention, wherein there is illustrated a tank car 255 which is provided with a pair of spaced-apart trucks 256 carrying wheels 257 adapted to ride on a standard railway rail. Each of the trucks 256 is also provided with a draft sill 258 and a coupling mechanism 259 at the end of the draft sill. The tank car 255 includes a generally cylindrical shell 261 closed at each end thereof by dome ends 262, thereby to form exposed lading structure. The car 255 is provided with a single sump 266 substantially in the center of the bottom wall 267 which slopes downwardly toward the sump 266 from each of the dome ends 262.

Tank car 255 is provided with a conduit 270 which includes a mounting flange 271 on the end thereof adjacent to the respective dome end 262 but inboard thereof. The conduit 270 includes an elongated pipe manifold 272 extending parallel to the longitudinal axis of the tank car 255 and inboard from the mounting flange 271. The pipe manifold 272 is in fluid communication with an eduction pipe 274 which extends vertically downwardly through the tank car 255 at substantially midway between the ends 262 thereof, the eduction pipe 274 having an end 275 terminating in the sump 266. The manifold pipe 272 is also in fluid communication with a vent pipe 277 extending vertically downwardly in the tank car 255 and having an end 278 thereof terminating a predetermined distance below the top of the tank car 255.

The eduction pipe 274 is provided with a butterfly valve 282 positioned in the manifold pipe 272 between the eduction pipe 274 and the vent pipe 277 externally of the tank car 255. The vent pipe 277 is also provided with a butterfly valve 283 positioned therein externally of the tank car 255. Proper controls (not shown) for the valves 282 and 283 provide independent operation thereof, enabling one of the valves to be opened while the other valve is shut.

The other end of the tank car 255 is provided with a conduit 290 similar to the conduit 270, which includes a mounting flange 291 positioned adjacent to the top of the tank car 255 at a point inboard of the adjacent dome end 262. An elongated manifold pipe 292 extends inboard from the mounting flange 291 and is generally parallel to the longitudinal axis of the tank car 255. The elongated manifold pipe 292 is in fluid communication with the centrally located downwardly extending eduction pipe 274, it being noted that a single eduction pipe 274 serves both the conduits 270 and 290. The manifold pipe 292 also is in fluid communication with the vent pipe 297 extending vertically downwardly from the top of the tank car 255 and having an end 298 terminating a predetermined distance below the top of the tank car 255.

A butterfly valve 302 is positioned in the manifold pipe 292 between the eduction pipe 274 and the vent pipe 297 externally of the car 255 and a butterfly valve 303 is positioned in the vent conduit 297 externally of the tank car 255. Suitable controls for the butterfly valves 302 and 303 are provided in the usual manner but are not herein illustrated. A plurality of spaced-apart support brackets 286 and 306, respectively, support the elongated manifold pipes 272 and 292.

Operation of the tank car 255 is similar in almost every detail to the operation of the tank car 55. Placement of the valves 282 and 302, respectively in the elongated pipe manifolds 272 and 292 and between the eduction pipe 274 and the respective vent pipes 277 and 297, functionally reproduce the spaced-apart eduction pipes 74 and 94 in the tank car 55. The tank car 255, like the tank car 55, may be loaded or unloaded from either end thereof, the advantage of the tank car 255 being an economy of materials in construction. For instance, if you were loading through the conduit 270 then the valve 282 is open and the valve 283 is closed and the valve 302 is closed and the valve 303 is open. Accordingly, if you were unloading through the conduit 290, then the valve 283 is open and the valve 282 is closed and the valve 302 is open and the valve 303 is closed, therby to permit a gas under pressure to be introduced into the tank car 255 through the vent pipe 277 and for the lading to exit through the eduction pipe 274 and the open valve 302 and thereafter through the pipe manifold 292 outwardly of the car. Accordingly, it is seen that the tank car 255 may be used in exactly the same manner as the tank car 55 with the added advantage of requiring less materials for construction on the inside of the tank, although this is somewhat compensated for by the elongated manifold pipes 272 and 292 which are required on the outside of the tank.

Figure 7:
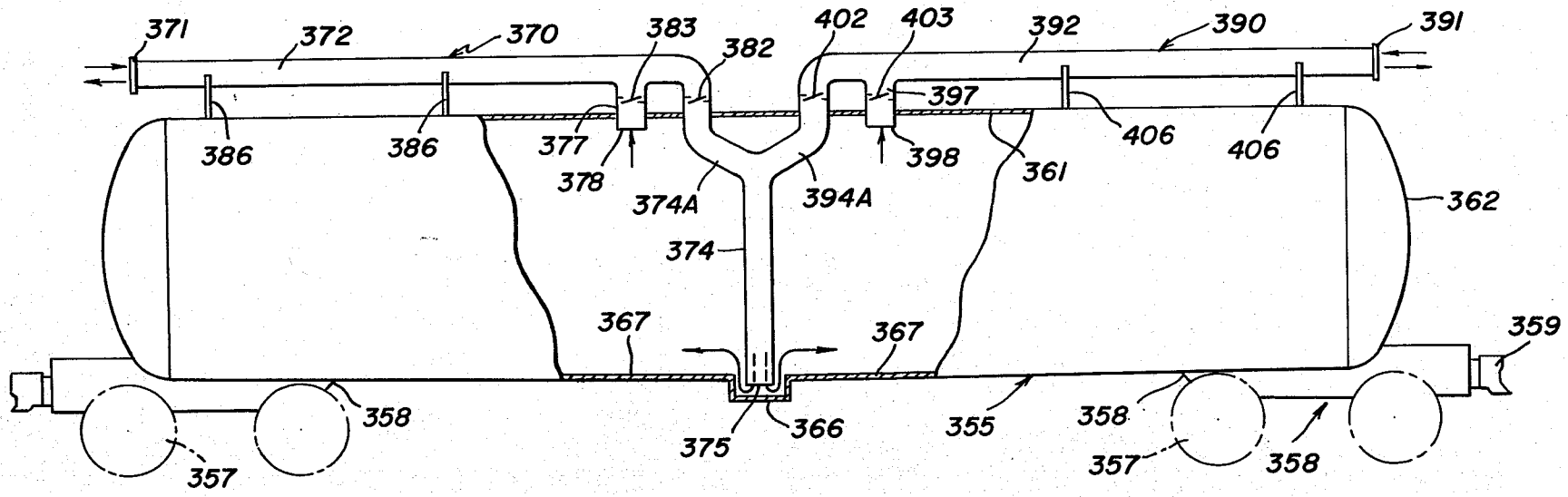
FIG. 7 is an elevation view partly in section of yet another embodiment of the present invention showing a common eduction conduit branching into two portions, each being provided with separate valving.

Referring now to FIG. 7, there is shown yet another embodiment of the present invention in which a tank car 355 is provided with a pair of spaced-apart trucks 356 carrying wheels 357 adapted to ride on a standard railway rail. Each of the trucks 356 is also provided with a draft sill 358 and a coupling mechanism 359 at the end of the draft sill. The tank car 355 includes a generally cylindrical shell 361 closed at each end thereof by dome ends 362, thereby to form a closed lading structure. The car 355 is provided with a single sump 366 substantially at the center of the bottom 367 which slopes downwardly toward the sump 366 from each of the dome ends 362.

The tank car 355 is provided with a conduit 370 which includes a mounting flange 371 at the end thereof adjacent to the respective dome 362 but inboard of the dome end. The conduit 370 includes an elonated pipe manifold 372 extending parallel to the longitudinal axis of the tank car 355 and inboard from the adjacent mounting flange 371 to substantially the center of the tank car. The pipe manifold 372 is in fluid communication with an eduction pipe 372 which extends vertically downwardly from the tank car 355, the eduction pipe 374 being connected to the pipe manifold 372 by a pipe section 374A. The eduction pipe 374 terminates at an end 375 positioned in registry with the sump 366. The manifold pipe 372 is also in fluid communication with a vent pipe 377 extending vertically downwardly into the tank car 355 and having an end 378 thereof terminating a predetermined distance below the top of the tank car 355.

The eduction pipe 374 is provided with a butterfly valve 382 positioned therein externally of the tank car 355. More particularly, the butterfly valve 382 is in a pipe section intermediate the longitudinally extending pipe manifold 372 and the connecting section 374A. Similarly, the vent pipe 377 is provided with a butterfly valve 383 positioned therein externally of the tank car 355. Proper and well known controls (not shown) for the valves 382 and 383 provide independent operation thereof enabling one of the valves to be open while the other valve is shut. A plurality of support brackets 386 suitably welded to the tank car 355 provide support for the elongated pipe manifold 372.

The other end of the tank car 355 is provided with a conduit 390, similar to the conduit 370, and includes a mounting flange 391 positioned adjacent to the top of the tank car 355 at a point inboard of the adjacent dome end 362. An elongated pipe manifold 392 extends inboard from the mounting flange 391 and is generally parallel to the longitudinal axis of the tank car 355. The manifold pipe 392 is in fluid communication with the vertically extending eduction pipe 374. A short vertical section is connected to a diagonal section 394A which provides the fluid communication between the manifold pipe 392 and the eduction pipe 374. The manifold pipe 392 is also in fluid communication with a vent pipe 397 extending vertically downwardly through the top of the tank car 355 and having an end 398 terminating a predetermined distance below the top of the tank car 355. A butterfly valve 402 is positioned in the eduction conduit externally of the tank car 355 and a butterfly valve 403 is positioned in the vent conduit 397 externally of the tank car 355. Suitable controls for the butterfly valves 402 and 403 are provided in the usual manner but are not herein illustrated.

It is seen, therefore, that there has been provided an alternative embodiment 355 of the tank car 55, which embodiment 355 operates in substantially the same manner and performs the same functions as hereinbefore disclosed with respect to the tank car 55. Specifically, each of the conduits 370 and 390 may function as an inlet conduit or an outlet conduit for either loading or unloading liquid lading into or out of the tank car 355. The principal difference between the embodiment 255 and 355 is in the construction of the eduction conduit and the placement of the valves 382 and 402 therein, as compared to placement of the valves 282 and 302 in the embodiment shown in FIG. 6. Specifically, the valves 382 and 402 are in vertically extending pipe sections as hereinbefore disclosed with respect to the embodiment shown in FIGS. 1 to 4, whereas the valves 282 and 302 in FIG. 6 are in horizontally disposed pipes, unlike that disclosed in FIGS. 1 to 4, 5 and 7. Accordingly, it is seen that the embodiment shown in FIG. 7 will function in the exact same manner as those embodiments hereinbefore described. It should be noted that the pipe manifold 392 is supported at intermediate points by brackets 406, much in the same manner as the pipe manifold 372 as supported by the brackets 386.

While there has been described what is at present considered to be the preferred embodiments of the present invention, it will be understood that various modifications and alterations may be made herein without departing from the true spirit and scope of the present invention, and it is intended to cover in the appended claims all such modifications and alterations as fall within the true spirit and scope of the present invention.

What is claimed is:

1. A railway tank car for interconnection in fluid communication with associated tank cars by flexible connecting conduits for accommodating consecutive loading, unloading, and transportation of expandable ladings, said tank car comprising a wheeled chassis structure provided with chassis coupling means for coupling to the chassis of associated cars, a tank mounted on said chassis structure, lading conduit means mounted on the top of said tank and having two outer ends extending outwardly from said tank adjacent to the top thereof, an eduction conduit having an outer end in fluid communication with said lading conduit means and having an inner end in fluid communication with the interior of said tank, the inner end of said eduction conduit being positioned near the bottom of said tank to facilitate the emptying of said tank through said eduction conduit, two vent conduits each having an outer end in fluid communication with said lading conduit means and having an inner end in fluid communication with the interior of said tank, the inner end of each of said vent conduits extending into said tank and terminating a predetermined distance below and near the top of said tank, and a plurality of valves for interrupting communication between said vent conduits and said lading conduit means and between said eduction conduit and said lading conduit means, whereby said tank may be loaded and unloaded from either end of said lading conduit means by adjustment of said valves to interrupt communication between the one end of said lading conduit means and the adjacent vent conduit and to interrupt communication between the other end of said conduit means and the eduction conduit.

2. The railway tank car set forth in claim 1, wherein the outer ends of said lading conduits terminate inboard of the associated tank car end.

3. The railway tank car set forth in claim 1, and further comprising a sump in the bottom of said tank in registry with the inner end of said eduction conduit.

4. The railway tank car set forth in claim 1, wherein said valves are mounted externally of said tank within the associated conduit.

5. A railway tank car for interconnection in fluid communication with associated tank cars by flexible connecting conduits for accommodating consecutive loadings, unloading, and transportation of expandable ladings, said tank car comprising a wheeled chassis structure provided with chassis coupling means for coupling to the chassis of associated cars, a tank mounted on said chassis structure, two lading conduit means mounted on the top of said tank and having two outer ends extending outwardly from said tank adjacent to the top thereof, two eduction conduits each having an outer end in fluid communication with said lading conduit means and having an inner end in fluid communication with the interior of said tank, each of said eduction conduits extending vertically downwardly in said tank and having an inner end thereof positioned near the bottom of said tank to facilitate the emptying of said tank through either of said eduction conduits, two vent conduits each having an outer end in fluid communication with said lading conduit means and having an inner end in fluid communication with the interior of said tank, the inner end of each of said vent conduits extending into said tank and terminating a predetermined distance below and near the top of said tank, and a plurality of valves for interrupting communication between said vent conduits and said lading conduit means and between said eduction conduits and said lading conduit means, whereby said tank may be loaded and unloaded from either end of said lading conduit means by adjustment of said valves to interrupt communication between the one end of said lading conduit means and the adjacent vent conduit and to interrupt communication between the other end of said lading conduit means and the adjacent eduction conduit.

6. The railway tank car set forth in claim 5, wherein said associated vent and eduction conduits are positioned near the associated tank end.

7. The railway tank car set forth in claim 5, and further comprising two sumps in the bottom of said tank each being in registry with the inner end of an associated eduction conduit.

8. A railway tank car for interconnection in fluid communication with associated tank cars by flexible connecting conduits for accommodating consecutive loadings, unloading, and transportation of expandable ladings, said tank car comprising a wheeled chassis structure provided with chassis coupling means for coupling to the chassis of associated cars, a tank mounted on said chassis structure, lading conduit means mounted on the top of said tank and having two outer ends extending outwardly from said tank adjacent to the top thereof, an eduction conduit having two outer ends each near an end of said tank and in fluid communication with a respective one of said outer ends of said lading conduit means and having the inner end in fluid communication with the interior of said tank, the inner end of said eduction conduit being positioned near the bottom of said tank to facilitate the emptying of said tank through said eduction conduit, a diagonally and downwardly extending conduit interconnecting each of said eduction conduit outer ends with said inner end, two vent conduits each having an outer end in fluid communication with said lading conduit means and having an inner end in fluid communication with the interior of said tank, the inner end of each of said vent conduits extending into said tank and terminating a predetermined distance below and near the top of said tank, and a plurality of valves for interrupting communication between said vent conduit and said lading conduits and between said eduction conduit and said lading conduit means, whereby said tank may be loaded and unloaded from either end of said lading conduit means by adjustment of said valves to interrupt communication between the one end of said lading conduit means and the adjacent vent conduit and to interrupt communication between the other end of said lading conduit means and the adjacent eduction conduit outer end.

9. The railway tank car set forth in claim 8, wherein said diagonally and downwardly extending conduits join to form a short vertical conduit with the inner end thereof disposed near the bottom of said tank.

10. The railway tank car set forth in claim 8, and further comprising a sump in the bottom of said tank substantially midway between the ends thereof, the bottom of said tank sloping downwardly from the ends thereof toward said sump, said inner end of said eduction conduit being in registry with said sump.

11. A railway tank car for interconnection in fluid communication with associated tank cars by flexible connecting conduits for accommodating consecutive loadings, unloading, and transportation of expandable ladings, said tank car comprising a wheeled chassis structure provided with chassis coupling means for coupling to the chassis of associated cars, a tank mounted on said chassis structure, lading conduit means mounted on the top of said tank and having two outer ends extending outwardly from said tank adjacent to the top thereof, an eduction conduit having an outer end in fluid communication with said lading conduit means and having an inner end in fluid communication with the interior of said tank, the inner end of said eduction conduit being positioned near the bottom of said tank to facilitate the emptying of said tank through said eduction conduit, two vent conduits on opposite sides of said eduction conduit each having an outer end in fluid communication with said lading conduit means and having an inner end in fluid communication with interior of said tank, the inner end of each of said vent conduits extending into said tank and terminating a predetermined distance below and near the top of said tank, and a plurality of valves for interrupting communication between said vent conduit and said lading conduits and between said eduction conduit and said lading conduit means, whereby said tank may be loaded and unloaded from either end of said lading conduit means by adjustment of said valves to interrupt communication between the one end of said lading conduit means and the adjacent vent conduit and to interrupt communication between the other end of said lading conduit means and the adjacent eduction conduit outer end.

12. The railway tank car set forth in claim 11, wherein said valves associated with said eduction conduit are positioned in said lading conduit means on each side of said eduction conduit intermediate said eduction conduit and the adjacent vent conduit.

13. A railway tank car for interconnecton in fluid communication with associated tank cars by flexible connecting conduits for accommodating consecutive loadings, unloading, and transportation of expandable ladings, said tank car comprising a wheeled chassis structure provided with chassis coupling means for coupling to the chassis of associated cars, a tank mounted on said chassis structure, lading conduit means mounted on the top of said tank and having two outer ends extending outwardly from said tank adjacent to the top thereof, an eduction conduit having two outer ends each near the center of said tank and in fluid communication with a respective one of said outer ends of said lading conduit means and having the inner end in fluid communication with the interior of said tank, the inner end of said eduction conduit being positioned near the bottom of said tank to facilitate the emptying of said tank through said eduction conduit, a diagonally and downwardly extending conduit interconnecting each of said eduction conduit outer ends with said inner end, two vent conduits each having an outer end in fluid communication with said lading conduit means and having an inner end in fluid communication with the interior of said tank, the inner end of each of said vent conduits extending into said tank and terminating a predetermined distance below and near the top of said tank, and a plurality of valves for interrupting communication between said vent conduit and said lading conduits and between said eduction conduit and said lading conduit means, whereby said tank may be loaded and unloaded from either end of said lading conduit means by adjustment of said valves to interrupt communication between the one end of said lading conduit means and the adjacent vent conduit and to interrupt communication between the other end of said lading conduit means and the adjacent eduction conduit outer end.

14. The railway tank car set forth in claim 13, wherein said diagonally downwardly conduits join to form an elongated vertically extending conduit.

15. A railway tank car train for accommodating consecutive loading, unloading and transportation of expandable ladings, said train comprising a plurality of railway tank cars connected in tandem relationship, each of said tank cars including a wheeled chassis structure provided with chassis coupling means for coupling to the chassis of associated cars, a tank mounted on said chassis structure, lading conduit means mounted on the top of said tank and having two outer ends extending outwardly from said tank adjacent to the top thereof, an eduction conduit having an inner end thereof in communication with the interior of said tank and being in fluid communication with each of said lading conduits, the inner end of said eduction conduit being positioned near the bottom of said tank to facilitate the emptying of said tank through said eduction conduit, two vent conduits each having an outer end in fluid communication with said lading conduits and an inner end in fluid communication with the interior of said tank, the inner end of each of said vent conduits extending into said tank and terminating a predetermined distance below and near the top of said tank, a plurality of valves for interrupting communication between said vent conduits and said lading conduit means and between said eduction conduits and said lading conduit means, and conduit coupling means on each of said lading conduit means for coupling to an associated end of an associated flexible connecting conduit to place said tank in fluid communication with the tanks of adjacent-like tank cars, whereby said tank train may be loaded and unloaded from either end thereof by adjustment of said valves on each of said tank cars to interrupt communication between the individual ends of said lading conduit means and the adjacent vent conduits and to interrupt communication between the other ends of the lading conduit means and the adjacent eduction conduits.

* * * * *